US010366819B2

(12) United States Patent
Sado et al.

(10) Patent No.: US 10,366,819 B2
(45) Date of Patent: Jul. 30, 2019

(54) COIL COMPONENT AND METHOD OF MANUFACTURING THE SAME

(71) Applicant: TAIYO YUDEN CO., LTD., Taito-ku, Tokyo (JP)

(72) Inventors: Atsushi Sado, Takasaki (JP); Chiharu Hayashi, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 15/276,669

(22) Filed: Sep. 26, 2016

(65) Prior Publication Data

US 2017/0092410 A1 Mar. 30, 2017

(30) Foreign Application Priority Data

Sep. 30, 2015 (JP) ..... 2015-195267

(51) Int. Cl.
*H01F 27/28* (2006.01)
*H01F 27/255* (2006.01)
(Continued)

(52) U.S. Cl.
CPC ..... *H01F 27/255* (2013.01); *H01F 17/043* (2013.01); *H01F 27/2828* (2013.01);
(Continued)

(58) Field of Classification Search
CPC .... H01F 27/28; H01F 27/255; H01F 27/2828; H01F 27/292
(Continued)

(56) References Cited

U.S. PATENT DOCUMENTS 4,841,428 A * 6/1989 Washburn ..... G05F 3/06 323/331
6,249,202 B1 * 6/2001 Yamada ..... H01F 27/29 336/192
(Continued)

FOREIGN PATENT DOCUMENTS

CN 1667763 A 9/2005
CN 103081045 A 5/2013
(Continued)

OTHER PUBLICATIONS

A First Office Action issued by the State Intellectual Property Office of China dated Feb. 28, 2018 for Chinese counterpart application No. 201610873946.8.
(Continued)

*Primary Examiner* — Tszfung J Chan
(74) *Attorney, Agent, or Firm* — Law Office of Katsuhiro Arai

(57) ABSTRACT

In an embodiment, an air-core coil 50 includes a winding part 54 formed by winding a coated conductive wire 52, wherein a pair of leader parts 56 and 58 is interposed between a second core 20 and a first core 40 which contain metal magnetic grains. A first gap 72 is provided between a principle face 50A of one end portion of the winding part 54 in the direction of a winding core axis of the winding part 54 and the first core member 40. A second gap 70 is provided between a principle face 50B of the other end portion and the second core member 20. The coil component is a small and high-performance coil component with a high dielectric withstanding voltage.

8 Claims, 8 Drawing Sheets

(51) Int. Cl.

| | |
|---|---|
| ***H01F 41/076*** | (2016.01) |
| ***H01F 27/29*** | (2006.01) |
| ***H01F 41/02*** | (2006.01) |
| ***H01F 17/04*** | (2006.01) |
| ***H01F 27/30*** | (2006.01) |

(52) U.S. Cl.
CPC ..... *H01F 27/292* (2013.01); *H01F 27/306* (2013.01); *H01F 41/0206* (2013.01); *H01F 41/076* (2016.01); *H01F 2017/046* (2013.01)

(58) Field of Classification Search
USPC ..... 336/83, 178, 196, 198, 212, 221
See application file for complete search history.

(56) References Cited

U.S. PATENT DOCUMENTS

| | | | | |
|---|---|---|---|---|
| 6,791,446 | B2 * | 9/2004 | Sato | H01F 3/14 336/110 |
| 7,986,208 | B2 * | 7/2011 | Yan | H01F 17/043 336/192 |
| 8,601,673 | B2 * | 12/2013 | Tseng | H01F 41/046 228/175 |
| 2002/0067237 | A1 * | 6/2002 | Nakata | H01F 27/29 336/212 |
| 2004/0070480 | A1 * | 4/2004 | Nakashima | H01F 27/2804 336/200 |
| 2006/0022788 | A1 * | 2/2006 | Sasamori | H01F 17/043 336/208 |
| 2007/0216512 | A1 * | 9/2007 | Sano | H01F 17/043 336/212 |
| 2012/0081205 | A1 * | 4/2012 | Nishino | H01F 17/04 336/84 M |
| 2014/0313002 | A1 * | 10/2014 | Kuo | H01F 27/24 336/178 |
| 2016/0086725 | A1 * | 3/2016 | Igarashi | H01F 27/29 336/83 |

FOREIGN PATENT DOCUMENTS

| | | | | | |
|---|---|---|---|---|---|
| CN | 204130313 | U | | 1/2015 | |
| DE | 2305957 | A1 | | 8/1974 | |
| GB | 1451842 | A | | 10/1976 | |
| JP | 56027908 | A | * | 3/1981 | H01F 27/22 |
| JP | 02285614 | A | * | 11/1990 | |
| JP | 10004021 | A | * | 1/1998 | |
| JP | H104021 | A | | 1/1998 | |
| JP | 2005123299 | A | | 5/2005 | |
| JP | 2013051402 | A | | 3/2013 | |
| JP | 2013145866 | A | | 7/2013 | |
| JP | 2014220292 | A | | 11/2014 | |

OTHER PUBLICATIONS

A Notification of Reasons for Refusal issued by the Japanese Patent Office, dated Mar. 6, 2018, for Japanese counterpart application No. 2015-195267.

* cited by examiner

COIL COMPONENT AND METHOD OF MANUFACTURING THE SAME

BACKGROUND

Field of the Invention

The present invention relates to a coil component and a method of manufacturing the same, and specifically, to a coil component with an air core without using a bobbin, and a method of manufacturing the same.

Description of the Related Art

As the performance of electronic equipment advances, high performance is required for components of the electronic equipment. Particularly, the computerization of automobiles progresses increasingly, and high performance is required is in demand for components used therein. For this reason, in recent years, a trend of the use of ferrite materials in the related art has been shifted to the use of metallic materials.

For example, Patent Literature 1 discloses a choke coil including an outer core which is a dust core, and of which at least an inner surface has a square frame shape; a bobbin which is mounted inside a frame of the outer core in a state where a coil is wound around the bobbin; an inner core that is a dust core, which is a magnetic core of the bobbin, has a shape of a core rod having a central axis parallel to the direction of a winding axis of the coil, and is inserted between two planes such that the central axis is perpendicular to the two planes which are the inner surface of the outer core and face each other; and a mold portion which is formed by filling a space between both end surfaces with resin, the outer core as the mold frame, and in which the coil and the bobbin are molded.

In an inductance element disclosed in Patent Literature 2, a coil is spirally wound by a rectangular flat metallic wire with a rectangular sectional shape so that one short side of the rectangular shape turns to the center side. Both end portions of the coil are lead outward from a wound portion. The outer circumference of the coil is covered with an insulating layer. Both end portions of the coil project outward from middle portions of two parallel side surfaces of a core which are positioned at the middle of the side surfaces in a height direction. Both end portions are first bent from the wound portion along the side surfaces of the core, and tip end portions of both end portions are bent along a back surface of the core. Since both end portions of the coil serve as terminals, both end portions are not covered with insulating layers. The core is manufactured by adding an insulating material into metal magnetic grains (Fe—Ni and the like), mixing together the insulating material and the metal magnetic grains, and applying pressure to the mixed material under predetermined conditions.

BACKGROUND ART LITERATURES

[Patent Literature 1] Japanese Patent Laid-open No. 2013-51402

[Patent Literature 2] Japanese Patent Laid-open No. 2013-145866

SUMMARY

Since the coil disclosed in Patent Literature 1 uses a bobbin, the size of the coil cannot be reduced, which is a problem. On the other hand, Patent Literature 2 discloses an example in which a bobbin is not used. The magnetic element is configured such that an air-core coil is embedded into a magnetic body, and the air-core coil is in direct contact with the metallic magnetic body. For this reason, it is necessary to take high degree of insulation and the like into consideration, and therefore, a method of adjusting the composition of the metal magnetic grains or increasing the amount of resin in the magnetic body has been used. However, this countermeasure restricts an improvement of performance of the magnetic body. Also, if a high voltage is applied to the element, electricity passes through the inside of the magnetic body. For the above reasons, there have been no small and high-performance components which can be used without restriction of use which specifically can be used in a high voltage condition until now.

The present invention was made in light of these problems, and an object of the present invention is to provide a small and high-performance coil component which can be used in a circuit or the like to which a high voltage is applied without restriction of use, and to provide a method of manufacturing the same.

Any discussion of problems and solutions involved in the related art has been included in this disclosure solely for the purposes of providing a context for the present invention, and should not be taken as an admission that any or all of the discussion were known at the time the invention was made.

A coil component of the present invention is characterized in providing: an air-core coil that is formed of a winding part which winds a coated conductive wire and includes an inner circumferential surface, an outer circumferential surface, and a principle face of one end portion and a principle face of the other end portion in the direction of a winding core axis, and of a pair of leader parts which lead outward from the winding part; a first core member that includes a shaft part disposed inside the inner circumferential surface, a side wall portion disposed in at least a portion of the outer circumferential surface, and a connection portion which is disposed such that a first gap is formed between the principle face of the one end portion and the connection portion, and through which the shaft part is connected to the side wall portion, and that contains metal magnetic grains; and a second core member which is disposed such that a second gap is formed between the principle face of the other end portion and the second core member and which contains metal magnetic grains.

A main embodiment of the coil component is characterized by having: a third gap between the shaft part and the second core member, and a fourth gap between the side wall portion and the second core member which is larger in distance than the third gap. Another embodiment is characterized by having: a fifth gap between the leader parts and a side surface of the second core member. Furthermore, another embodiment is characterized in that the second core member is an E-type or I-type.

A method of manufacturing a coil component proposed by the present invention is characterized by comprising: a preparation step of obtaining a first core member of an E-type and a second core member of an E-type or an I-type by forming and heat-treating metal magnetic grains; another preparation step of obtaining an air-core coil which is formed of a winding part formed by winding a coated conductive wire, and of a pair of leader parts which lead outward from the winding part, and obtaining terminal electrodes electrically connected to the air-core coil; a step of installing the air-core coil in the second core member; a step of applying an adhesive to the second core member; a step of disposing the first core member such that the air-core coil is disposed between the second core member and the first core member; and a step of curing the adhesive.

A main embodiment is characterized in that the terminal electrodes are formed by installing the air-coil in the second core member after bending conductor portions that extend from the leader parts, or after connecting terminal members to the conductor portions via soldering or bending. Another embodiment is characterized in that a first gap is formed between the first core member and the air-core coil in an interposed manner, and a second gap is formed between the second core member and the air-core coil in an interposed manner. Yet another embodiment is characterized in that a fifth gap is provided between the second core member and the leader parts. The aforementioned objects, characteristics, and advantages and other objects, characteristics, and advantages of the present invention will become apparent from the following detailed description and the accompanying drawings.

According to the invention, it is possible to obtain a small and high-performance coil component with a high dielectric withstand voltage.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIG. 1A is a plan view, FIG. 1B is a side view of FIG. 1A from the direction of arrow F1, and 1C is a bottom view.

FIG. 3A is a plan view, FIG. 3B is a sectional view of FIG. 3A, cut along line #B-#B from the direction of arrows, FIG. 3C is a side view of FIG. 3A from the direction of arrow F3, and FIG. 3D is an exterior perspective view.

FIG. 4A is a plan view, FIG. 4B is a sectional view of FIG. 4A, cut along line #D-#D and is viewed in the direction of arrows, and FIG. 4C is a side view of FIG. 4A from the direction of arrow F4.

FIGS. 5A-1 and 5A-2 are views illustrating an example in which terminal electrodes are formed via bending, and FIGS. 5B-1 and 5B-1 are views illustrating an example in which terminal electrodes are formed by respectively connecting metal plates to leader parts via soldering and/or bending.

DESCRIPTION OF THE SYMBOLS

10, 10A, 10B: COIL COMPONENT
20, 20A TO 20E: SECOND COIL MEMBER
22, 22A, 22B: SHAFT PART
24: SIDE WALL PORTION
26: CONNECTION PORTION
27, 27A TO 27D: SIDE SURFACE
28: TAPERED SURFACE
29: BOTTOM SURFACE
30: STEPPED PORTION
32: GROOVE
34: CONCAVE PART
40, 40A, 40B: FIRST CORE MEMBER
42: SHAFT PART
44: SIDE WALL PORTION
46: CONNECTION PORTION
47: SIDE SURFACE
48: GROOVE
50: AIR-CORE COIL
50A: PRINCIPLE FACE OF ONE END PORTION
50B: PRINCIPLE FACE OF OTHER END PORTION
52: COATED CONDUCTIVE WIRE
54: WINDING PART
54A: INNER CIRCUMFERENTIAL SURFACE
54B: OUTER CIRCUMFERENTIAL SURFACE
56, 58: LEADER PART
57, 59: METAL PLATE
60, 62: TERMINAL ELECTRODE
64: DUMMY TERMINAL
66, 68: ADHESIVE
70: SECOND GAP
72: FIRST GAP
74: FIFTH GAP
76: THIRD GAP
78: FOURTH GAP

DETAILED DESCRIPTION OF EMBODIMENTS

A preferred embodiment of the present invention is described in detail below based on examples.

Example 1

Figure 1A:
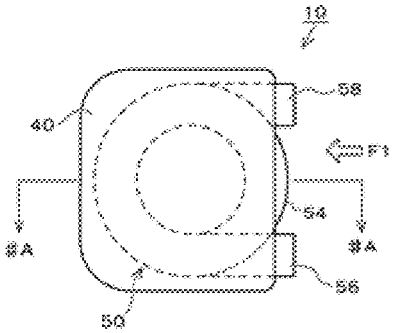
FIGS. 1A to 1C show a coil component in Example 1 of the present invention.
Figure 1B:
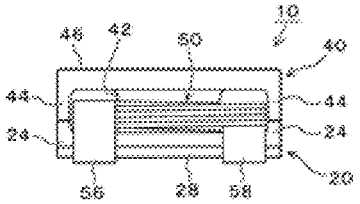
Figure 1C:
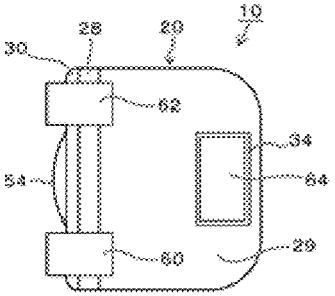

Initially, Example 1 of the present invention is described with reference to FIGS. 1A to 7B. FIG. 1A is a plan view of a coil component 10, FIG. 1B is a side view of FIG. 1A from the direction of arrow F1, and FIG. 1C is a bottom view. As illustrated in these drawings, the coil component 10 in the example is constituted by a pair of core members, that is, a second core member 20 and a first core member 40, and an air-core coil 50 interposed between the pair of core members. For descriptive purposes, a lower side represents a side of the coil component 10 which is disposed on a substrate when the coil component 10 is mounted on the substrate, and an upper side represents a side of the coil component 10 which is opposite to the substrate. The upper side and the lower side mean with reference to a vertical direction.

Figures 1, 5A:
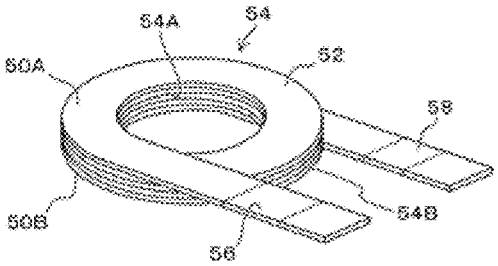
FIGS. 5A-1 to 5B-2 show an air-core coil in an example of the present invention.
Figures 2, 5A:
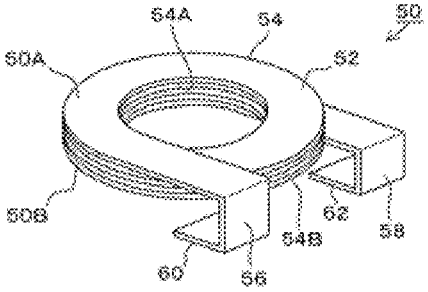
Figures 1, 5B:
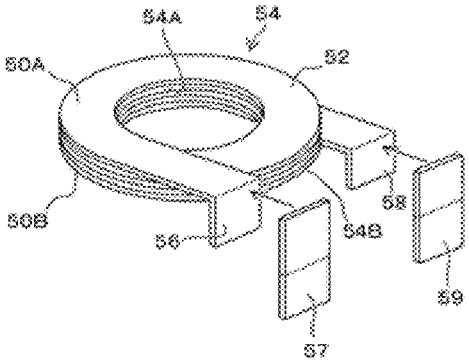
Figures 2, 5B:
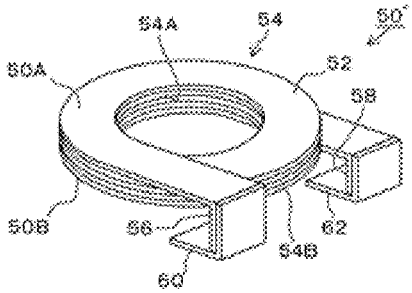

First, the air-core coil 50 is described with reference to FIG. 5A-1 to 5B-2. FIG. 5A-1 to 5B-2 show the air-core coil 50 of the coil component 10. FIGS. 5A-1 and 5A-2 are views illustrating an example in which terminal electrodes are formed by peeling the coatings of both end portions of a coated conductive wire, and by bending both end portions. FIGS. 5B-1 and 5B-2 are views illustrating an example in which terminal electrodes are formed by respectively connecting metal plates 57 and 59 to leader parts 56 and 58, which lead outward from both end portions of the coated conductive wire, via welding or soldering, and by bending the metal plates 57 and 59. Either the air-core coil 50 or an air-core coil 50' is formed of a winding part 54; the leader parts 56 and 58 connected to the winding part 54; and terminal electrodes 60 and 62 which are electrically connected to the leader parts 56 and 58. An electrical conduction path is formed between the terminal electrodes. The winding part 54 includes an inner circumferential surface 54A; an outer circumferential surface 54B; and a principle face 50A of one end portion and a principle face 50B of the other end portion in the direction of a winding core axis. The direction of a winding core axis represents the direction of magnetic flux that passes through the inner circumferential surface 54A. Here, the direction of a winding core axis refers to a direction that passes through an area which is surrounded by the inner circumferential surface 54A, from the principle face 50A of the one end portion toward the principle face 50B of the other end portion. The leader parts 56 and lead both ends of an insulation-coated conductive wire 52 outward from the outer circumferential surface 54B of the winding part 54, and bending both ends in the direction of the principle face 50B of the other end portion. The terminal electrodes 60 and 62 are disposed substantially parallel to the principle face 50B of the other end portion while being spaced a predetermined distance from the principle face 50B of the other end portion. When the air-core coil 50 is viewed in a direction perpendicular to the direction of a core winding axis, at least a portion of the principle face 50B of the other end portion is parallel to the terminal electrodes 60 and 62, and the winding part 54 is connected to one end of each of the terminal electrodes 60 and 62 via the leader parts 56 and 58. For example, the air-core coil 50 has a J or U shape which is horizontally placed.

Next, a specific example in which the terminal electrodes are formed via bending is described. As illustrated in FIG. 5A-1, the winding part 54 is formed by spirally winding the coated conductive wire 52, and the leader parts 56 and 58 are formed by leading both end portions of the winding part 54 outward in the same direction. In this example, a conductor called a rectangular wire having the shape of a rectangular section with a pair of long sides and a pair of short sides is used as the coated conductive wire 52, and the coated conductive wire 52 is spirally wound by a well-known technique in such a way that the long sides are superimposed on top of each other. A conductive portion of the coated conductive wire 52 is formed by copper for example, and an insulating coating surrounding the conductive portion is polyesterimide, urethane, or the like, and may be high heat-resistant polyamidimide or polyimide. And, the terminal electrodes 60 and 62 illustrated in FIG. 5A-2 are formed by peeling coatings from the leader parts 56 and 58 to both end portions of the conductor, by soldering the copper from which the coating is peeled, and by bending both end portions.

Alternatively, the terminal electrodes 60 and 62 illustrated in FIG. 5B-2 may be formed by respectively connecting the metal plates 57 and 59 for terminal electrodes to the leader parts 56 and 58 by welding or soldering, and by bending the metal plates 57 and 59 as illustrated in FIG. 5B-1. In this case, as the material of the metal plates 57 and 59, the same material as that of the conductive portion of the coated conductive wire 52 may be used, copper or phosphor bronze may be used since they have low resistance and are easy to bend, or a different metallic material (for example, an alloy containing any one of nickel, zinc, tin, manganese, and silver) may be used, or a Ni/Sn plating may be applied. As such, in this example, the winding part 54 is formed before the air-core coil 50 is installed in the second core member 20 and the first core member 40, and the terminal electrodes 60 and 62 are respectively formed from the leader parts 56 and 58 which are led outward from the winding part 54. Also, the welding or soldering and bending may be performed in the order of the welding or soldering after the bending.

Figure 3A:
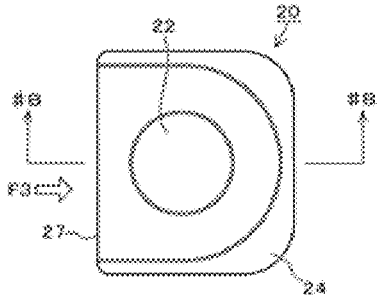
FIGS. 3A to 3D show a second core member in Example 1.
Figure 3B:
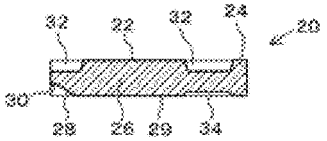
Figure 3C:
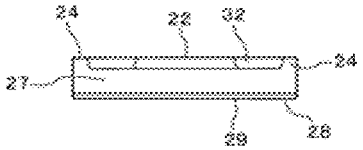
Figure 3D:
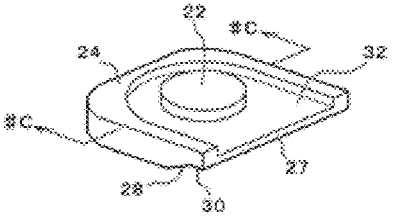

Next, the second core member 20 is described with reference to FIGS. 3A to 3D. FIGS. 3A to 3D show the second core member 20; FIG. 3A is a plan view, FIG. 3B is a sectional view of FIG. 3A, cut along line #B-#B and is viewed in the direction of arrows, FIG. 3C is a side view of FIG. 3A from the direction of arrow F3, and FIG. 3D is an exterior perspective view. As illustrated in FIG. 3D, the second core member 20 is called an E-type core, and is constituted by a shaft part 22 disposed inside the winding part 54 of the air-core coil 50; a side wall portion 24 disposed in at least a portion of an area outside the winding part 54 of the air-core coil 50; and a connection portion 26 through which the shaft part 22 is connected to the side wall portion 24. It should be noted that the E-type core here represents a core that includes the side wall portions 24 on both sides of the shaft part 22 in a sectional view (refer to FIG. 8E) of FIG. 3D cut along line #C-#C and is viewed in the direction of arrows (similarly, this applies to the following description). In this example, the shaft part 22 has a substantially circular sectional shape. Also, the side wall portion 24 is not formed on a side surface 27 side of the second core member 20, and the shape of an inner circumferential surface is such that a semicircle is formed at one long side of a rectangular shape, and continues to the other sides of the rectangular shape. And, a groove 32 is formed by the connection portion 26 through which the shaft part 22 is connected to one end of the side wall portion 24 in order to position the winding part 54 of the air-core coil 50 between the shaft part 22 and the side wall portion 24.

In this example, as described above, the side wall portion 24 is not formed in one side surface 27 of the second core member 20. This is because when the air-core coil 50 is installed in the second core member 20, the air-core coil 50 is inserted from the side surface 27 side, in such a way that the side surface 27 faces the leader parts 56 and 58 of the air-core coil 50. Also, the second core member 20 includes a bottom surface 29 on which the terminal electrodes 60 and 62 are disposed, and a tapered surface 28 is connected in the direction extending from the side surface 27 toward the bottom surface 29. A stepped portion 30 parallel to the bottom surface 29 may be provided between the side surface 27 and the tapered surface 28. The tapered surface 28 and the stepped portion 30 are formed to reduce a load applied when the air-core coil 50 is slid in a step (refer to FIGS. 6A to 6E) of assembling the air-core coil 50 by connecting in the direction extending from the side surface toward the bottom surface. It should be noted that in the illustrated example, the stepped portion 30 is provided; however, only the tapered surface 28 may be provided. The stepped portion 30 is to prevent the occurrence of burrs during the molding process, and used when the size of the tapered surface 28 is small and when a taper length is 0.5 mm or less for example. Further, a concave part 34 is formed on the bottom surface 29 of the second core member 20 at a suitable position to fix a dummy terminal 64 which has the same thickness as that of the terminal electrodes 60 and 62 disposed on the bottom surface 29, and provides mounting stability.

Figure 4A:
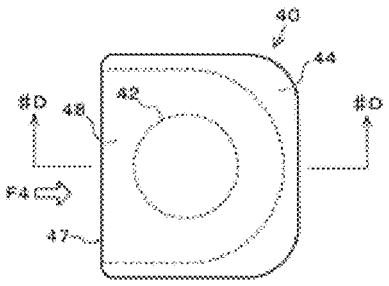
FIGS. 4A to 4C show a first core member in Example 1.
Figure 4B:
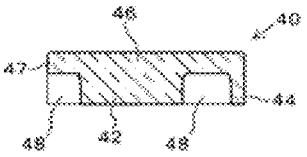
Figure 4C:
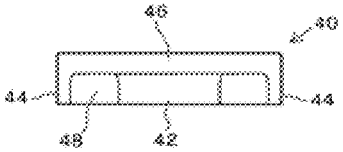

Next, an example of the first core member 40 is described with reference to FIGS. 4A to 4C. FIGS. 4A to 4C show the first core member 40; FIG. 4A is a plan view, FIG. 4B is a sectional view of FIG. 4A, cut along line #D-#D and is viewed in the direction of arrows, and FIG. 4C is a side view of FIG. 4A from the direction of arrow F4. As illustrated in FIGS. 4A to 4C, the first core member 40 includes: a shaft part 42 disposed inside the winding part 54 of the air-core coil 50; a side wall portion 44 disposed in at least a portion of an area outside the winding part 54 of the air-core coil 50; a connection portion 46 through which the shaft part 42 is connected to the side wall portion 44, and is an E-type core containing metal magnetic grains. In this example, the shaft part 42 has a substantially circular sectional shape. Also, the side wall portion 44 is not formed on a side surface 47 side of the first core member 40, and the shape of an inner circumferential surface is a semicircle which is formed at one long side of a rectangular shape, and continues to the other sides of the rectangular shape. And, a groove 48 is formed between the shaft part 42 and the side wall portion 44 to dispose the winding part 54 of the air-core coil 50. It should be noted that the side wall portion 44 is not formed on the side surface 47 side. The reason for this is that the leader parts 56 and 58 of the air-core coil 50 are prevented from coming into contact with the respective grooves 32 and 48 of the first core member 20 and the second core member 40 after the air-core coil 50 is installed in the second core member 20, and then the first core member 40 is installed in the second core member 20.

The second core member 20 and the first core member 40 are formed of metal magnetic grains. For example, a core which is a magnetic body is obtained by using metal magnetic grains of FeSiCr; adding a binder or the like; filling a die with metal magnetic grains; molding by applying pressure; and then heat-treating. The metal magnetic grains may be FeSiAl, or alloy particles containing Ni, Ti, and Co in addition to Si, Cr, and Al, and contain 92.5 wt % to 96 wt % of Fe, 4 wt % to 7.5 wt % of components other than Fe, and impurities other than the aforementioned components. Examples of the binder include PVA, PVB, and silicone, and a molding material is obtained by mixing the metal magnetic grains with a binder. Or, after the surfaces of metal magnetic grains are coated with glass, the metal magnetic grains may be mixed with a binder. Molding is performed using a die having a desired shape, and compact are obtained by applying a molding pressure of 6 ton/cm$^2$ to 16 ton/cm$^2$ to the molding material. Thereafter, the first core member 40 and the second core member 20 are obtained by removing the binder from the compact at a temperature of 200° C. to 300° C., and then heat treating them in oxidizing atmosphere at a temperature of 600° C. to 850° C.

The magnetic metallic grains are bonded together via oxide coatings such that the obtained core members 20 and 40 are formed. The oxide coating is a Si or Zr oxide coating, and a crystalline oxide coating may be provided on the outside of the oxide coating. Si or Zr oxide coatings increase a dielectric withstand voltage between the metal magnetic grains, and thus, it is possible to reduce a distance between the winding part 54 and the groove 48 in a first gap 72, and a distance between the winding part 54 and the groove 32 in a second gap 70. Also, the crystalline oxide coatings are capable of increasing bonding between the metal magnetic grains, and are to not only increase mechanical strength of the core members, but also to protect the Si or Zr oxide coatings, and are capable of preventing insulation degradation or the occurrence of rust. Also, the crystalline oxide coatings serve to prevent the oxidation of the surfaces of the metal magnetic grains, and as a result, prevent the occurrence of excessive oxidation, which makes it possible to reduce a change in the dimensions of the core members when being heat-treated. That is, the obtained core members have substantially the same dimensions as those of the compacts, and it is possible to obtain the core members with high dimensional accuracy while preventing the occurrence of a deformation caused by the heat treatment.

Figure 6A:
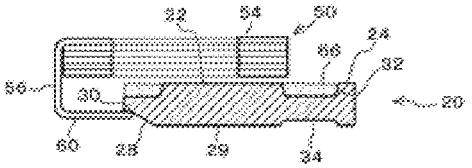
FIGS. 6A to 6E show views illustrating an example of the sequence of assembling the coil component in Example 1.
Figure 6B:
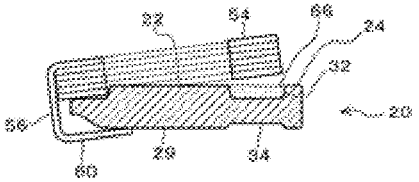
Figure 6C:
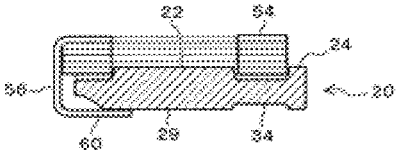

Next, a method of manufacturing the coil component 10 in the example is described with reference to FIGS. 6A to 6E. FIGS. 6A to 6E show views illustrating an example of the sequence of assembling the coil component 10 in this example. It is assumed that the second core member 20 and the first core member 40 are manufactured in advance via the aforementioned method. It is also assumed that as illustrated in FIGS. 5A-1 to 5B-2, the air-core coil 50 is manufactured by forming the winding part 54, and then forming the terminal electrodes 60 and 62 from the leader parts 56 and 58. And, as illustrated in FIG. 6A, with the leader parts 56 and 58 facing the side surface 27 of the second core member 20, the air-core coil 50 is slid in such a way that the second core member 20 is interposed between the winding part 54 and the terminal electrodes 60 and 62 (refer to FIG. 6B). It should be noted that as illustrated in FIG. 6A, an adhesive 66 may be applied to the groove 32 of the second core member 20 in advance. Or, as illustrated in FIG. 8D, in a case where the second core member is a plate-shaped I-type core member, in order to prevent an adhesive from flowing outward from the core member, the adhesive may be injected into the inside of the winding part 54 after the air-core coil 50 has been slid. According to either of the methods, as a result, the winding part 54 adheres to and is fixed to the second core member via the adhesive. Also, as illustrated in FIG. 6C, the adhesive 66 is present between the second core member 20 and the winding part 54. The adhesive 66 is applied in such a way that the second gap 70 between the second core member 20 and the principle face 50B of the other end portion of the winding part 54 is filled. Since the adhesive 66 is present in the second gap 70, it is possible to further increase insulating properties.

Figure 6D:
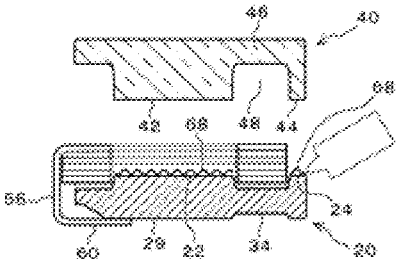
Figure 6E:
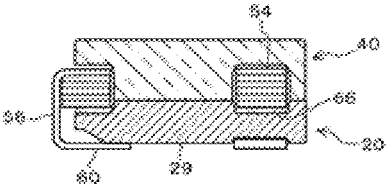

As described above, since the stepped portion 30 and the tapered surface 28 are provided in an edge portion of the bottom surface 29 of the second core member 20, when the air-core coil 50 is installed in the second core member 20 while being slid, a load applied during sliding is reduced. And, as illustrated in FIG. 6C, if the winding part 54 climbs over the shaft part 22, and the winding part 54 is fitted into the groove 32 on the outer circumferential side of the shaft part 22, the second core member 20 and the air-core coil 50 are fixed together via the adhesive 66. Thereafter, as illustrated in FIG. 6D, the first core member 40 and the second core member 20 is fixed together by: applying an adhesive 68 to an upper surface of the shaft part 22 or the side wall portion 24; installing the first core member 40 in the second core member 20 by pressing while heating. That is, it is a structure in which the air-core coil 50 is interposed between the second core member 20 and the first core member 40 from the direction of a winding core axis of the winding part 54 of the air-core coil 50. It should be noted that adhesion can be complete using only the adhesive 66. Particularly, in a case where the adhesive area of the side wall portion 24 is small, the adhesive 68 may flow outward from the side wall portion 24, and for this reason, it may be better that the adhesive is not applied. Finally, as illustrated in FIG. 6E, the manufacturing of the coil component 10 is completed by fixing the dummy terminal 64, which is provided to align with the height of the terminal electrodes 60 and 62, to the concave part 34 of the bottom surface 29 of the second core member 20 via an adhesive. For example, a terminal, which is obtained by applying an Ni/Sn plating to a single surface of a Cu plate, is used as the dummy terminal 64.

Figure 7A:
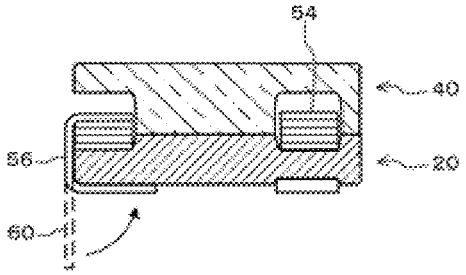
FIGS. 7A and 7B show views illustrating an example of the sequence of assembling a coil component in a comparative example.
Figure 7B:
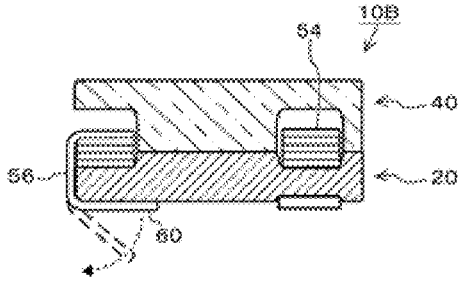

In this example, as described above, the terminal electrodes 60 and 62 are formed from the leader parts 56 and 58 of the air-core coil 50 in advance, and then the air-core coil 50 is installed in the second core member 20. In contrast, in a coil component 10B illustrated in FIGS. 7A and 7B, the air-core coil 50 is interposed between the second core member 20 and the first core member 40, and then tip ends of the leader parts 56 and 58 are bent. As illustrated in FIG. 7A, in a case where terminal electrodes are formed by bending tip ends of a coated conductive wire after assembling the air-core coil 50, it is necessary to perform bending in a state where the conductor is in contact with the second core member 20, and it is not possible to apply a strong force so as to prevent the occurrence of breakage of the core member or scratches to the coated conductive wire. Also, as illustrated in FIG. 7B, since force acts on the coated conductive wire to restore the shape of the coated conductive wire to an original shape even after the coated conductive wire is bent, variations in the dimensions of the terminal electrodes may occur. For this reason, there may be restriction to the thickness of a conductor wire used. In contrast, according to the method of performing assembly after terminal electrodes are formed, since a conductor is not subjected to such restriction, and the dimensions of the bent terminal electrodes 60 and 62 are stable, terminal floating or the like during mounting does not occur.

Figure 2A:
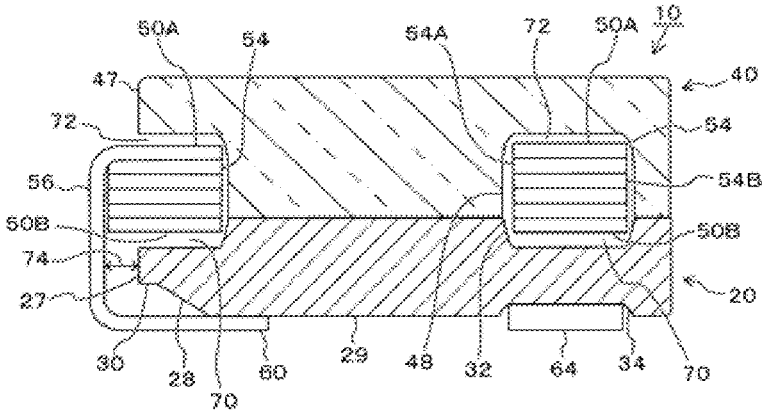
FIG. 2A is a sectional view of FIG. 1A, cut along line #A-#A from the direction of arrows.
Figure 2B:
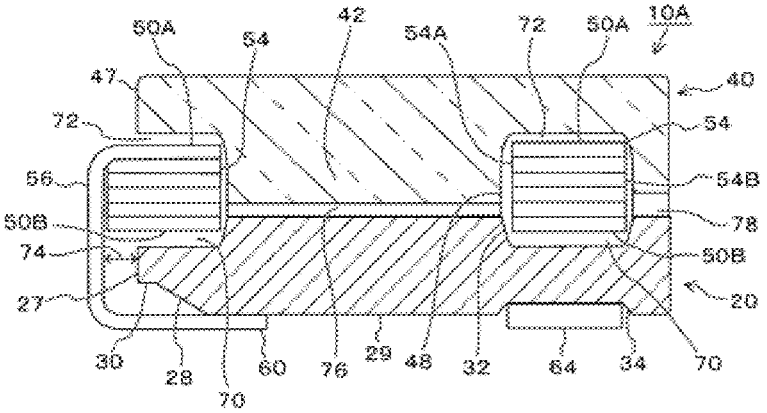
FIG. 2B is a sectional view illustrating a deformation example.

Hereinafter, structural characteristics of the coil component in this example are described with reference to FIG. 2A. FIG. 2A is a sectional view of FIG. 1A, cut along line #A-#A and is viewed in the direction of arrows. A deformation example illustrated in FIG. 2B will be described later. As illustrated in FIG. 2A, in this example, the principle face 50A of the one end portion of the air-core coil 50 is not in contact with the first core member 40, and the principle face 50B of the other end portion of the air-core coil 50 also is not in contact with the second core member 20. That is, the number of turns of the winding part 54, the depths of the grooves 32 and 48, and the distance between the winding part 54 and the terminal electrodes 60 and 62, and the like are determined in such a way that the first gap 72 is formed between the principle face 50A of the one end portion of the air-core coil and a bottom surface of the groove 48 of the first core member 40, and the second gap 70 is formed between the other principle face 50B of the air-core coil and a bottom surface of the groove 32 of the second core member 20. As such, if the winding part 54 of the air-core coil 50 is floated from the core surfaces, it is possible to reliably ensure insulation between the winding part 54 and the core members 20 and 40. Such an effect is obtained by the method of performing assembly after the terminal electrodes are formed.

Also, as illustrated in FIG. 2A, the side surface 27 of the second core member 20 is not in contact with the leader parts 56 and 58 of the air-core coil 50, and a fifth gap 74 is formed therebetween. As such, since the fifth gap 74 is formed between the second core member 20 and the leader parts 56 and 58, it is possible to reduce force occurring due to vibration or the like after the core component 10 is mounted on a substrate. Also, it is possible to have flexibility of compensating for behavioral differences caused by a difference between the coefficients of thermal expansions of the materials of the members. Such an effect is obtained by the method of installing the air-core coil 50 in the second core member 20 after the terminal electrodes are formed. In this case, the distance between the bottom surface 50B of the winding part 54 and the terminal electrodes 60 and 62 is desirably smaller than a dimension from the bottom surface 29 of the second core member 20 to an end surface of the shaft part 22. If the distance is set in this range, while ensuring the second gap 70, it is possible to reduce the height dimension of the coil component without having a useless space.

According to Example 1, the following effects are obtained.

1) The air-core coil 50 includes the winding part 54 formed by winding the coated conductive wire 52, and the pair of leader parts 56 and 58 which lead outward from the winding part 54. The air-core coil 50 is interposed between the second core member 20 and the first core member 40, which are formed of metal magnetic grains, in the direction of a winding core axis of the winding part 54. Also, the pair of core members 20 and 40 are E-type cores which are configured to respectively include the shaft parts 22 and 42 disposed inside the winding part 54; the side wall portions 24 and 44 which interpose the winding part 54 between the shaft parts 22 and 42 and the side wall portions 24 and 44; and the connection portions 26 and 46 through which the shaft parts 22 and 42 are connected to the side wall portions 42 and 44. And, the upper surface 50A of the winding part 54 is not in contact with the first core member 40, and the bottom surface 50B of the winding part 54 is not in contact with the second core member 20. That is, the first gap 72 of a predetermined distance is provided between the first core member 40 and the air-core coil 50, and the second gap 70 of a predetermined distance is provided between the second core member 20 and the air-core coil 50. Accordingly, it is possible to obtain the coil component 10 which is small and has a high dielectric withstand voltage without using a bobbin or the like. The coil component in the example withstands a voltage load of 1 kV, and does not undergo dielectric breakdown in this voltage range. An adhesive is applied to at least one of the first gap 72 and the second gap 70. The use of the adhesive leads to a higher dielectric withstand voltage, and since the winding part 54 is fixed to the core members, it is possible to not only make the core component robust against impact, but also prevent the occurrence of vibration of a coil caused by the application of current to the coil after the coil component is mounted on a substrate.

2) Since the fifth gap 74 of a predetermined distance is provided between the leader parts 56 and 58 of the air-core coil 50 and the side surface 27 of the second core member 20, it is possible to reduce force occurring due to vibration or the like after the core component is mounted on the substrate, and it is possible to prevent the occurrence of an open circuit or the like. Also, it is possible to have flexibility of compensating for behavioral differences caused by a difference between the coefficients of thermal expansions of the members. Moreover, it is possible to prevent the leaking of current from the terminal electrodes 60 and 62 to the air-core coil 50 via the second core member 20 even if a sudden high voltage is applied.

3) Before the air-core coil 50 is installed in the cores, the terminal electrodes 60 and 62 are formed in advance from the conductive portions of the leader parts 56 and 58 via soldering or bending after the winding part 54 is formed in the air-core coil 50. For this reason, it is possible to increase dimensional accuracy of respective mounting surfaces of the terminal electrodes 60 and 62 with respect to the substrate, and as a result, in a case where a conductor having a large sectional area is used as the conductor 52, it is possible to reliably mount the coil component on the substrate.

4) Since the stepped portion 30 and the tapered surface 28 are provided on a bottom surface side of the second core member 20 on which the side surface 27 is positioned, it is possible to reduce a load applied when the air-core coil 50 is slid and installed in the second core member 20.

5) Since the dummy terminal 64 is provided on the bottom surface 29 of the second core member 20 to align with the height of the terminal electrodes 60 and 62, it is possible to maintain stability of the core component 10 during mounting.

The present invention is not limited to the aforementioned example, and changes can be made in various forms insofar as the changes do not depart from the concept of the present invention. For example, the following changes may be included.

1) The shapes, the dimensions, and the materials illustrated in the example are given as examples, and may be suitably changed whenever necessary.

2) In the example, the first gap 72 is provided between the winding part 54 of the air-core coil 50 and the first core member 40, the second gap 70 is provided between the winding part 54 and the second core member 20, and the fifth gap 74 is provided between the leader parts 56 and 58 of the air-core coil 50 and the side surface 27 of the second core member 20. In addition to providing those gaps, a magnetic gap may be provided between the second core member 20 and the first core member 40. For example, as in a coil component 10A illustrated in FIG. 2B, a fourth gap 78 between the side wall portion 44 of the first core member 40 and the second core member 20 is set to be larger than a third gap 76 between the shaft part 42 of the first core member 40 and the second core member 20. The reason for this is that in a case where the third gap 76 and the fourth gap 78 are the same size, it is necessary to adjust a distance between the surfaces of the gaps over the entirety of surfaces, and variations in the distance cause changes in characteristics. In contrast, in a case where the fourth gap 78 is larger than the third gap 76, the range of adjustment is reduced to only the third gap 76, and a distance between the surfaces of the gap is adjusted, and as a result, stability of assembly is good, and if the fourth gap 78 of a large distance is set, the core member is less affected by a change in the magnetic gap, and stability of inductance characteristics becomes good.

Figure 8A:
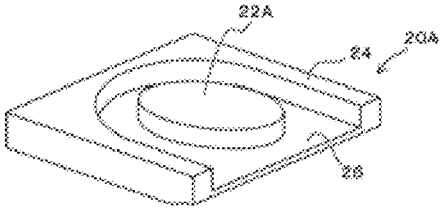
FIGS. 8A to 8E show views illustrating other examples of the present invention.
Figure 8B:
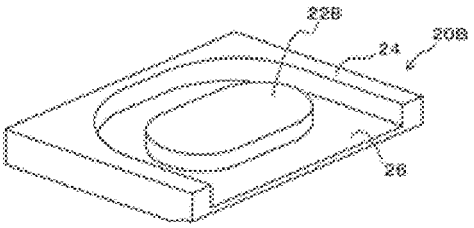

3) In the example, the shaft part 22 of the second core member 20 has a substantially circular sectional shape which is given as an example; as in a second core member 20A illustrated in FIG. 8A, a shaft part 22A may have an elliptical sectional shape; and as in a second core member 20B illustrated in FIG. 8B, a shaft part 22B may have a substantially racetrack-like sectional shape. Alternatively, the second core member may have a sectional shape obtained by rounding corners of a rectangular shape (not illustrated).

Figure 8C:
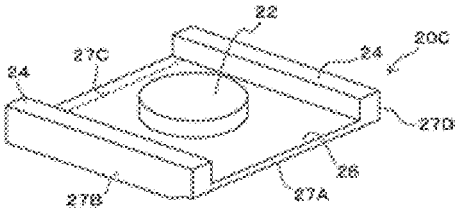
Figure 8D:
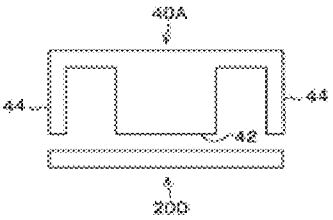

4) The E-type core illustrated in the Example 1 is given as an example. When a section passing through the shaft part 22 of the second core member 20 is viewed, the second core member 20 may be shaped to have the side wall portions on both sides of the shaft part. For example, as an example illustrated in FIG. 8C, even if side wall portions are not provided on the upper side surfaces 27A and 27C of a second core member 20C, and the side wall portions 24 are provided on only the upper side surfaces 27B and 27D, it is possible to obtain the same effects.

Figure 8E:
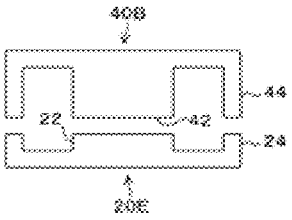

5) Also, in a case where both core members are E-type cores as in Example 1, the heights of the shaft parts or the side wall portions of both core members are not necessarily required to be the same, and as in an example illustrated in FIG. 8E, the height of the shaft part or the side wall portion of a first core member 40B may be larger than that of a second core member 20E. As a result, it is possible to easily install the air-core coil 50 in the second core member 20E. Also, as illustrated in FIG. 8D, a second core member 20D may be an I-type core, and a first core member 40A may be an E-type core. It is possible to reduce variations in magnetic gap by half by adopting an I-type core as one core member.

6) In the example, the conductor 52 forming the air-core coil 50 is a rectangular wire having a substantially rectangular sectional shape, which is given as an example, and various well-known conductors may be used.

According to the present invention, a coil component configured to include an air-core coil formed from a coated conductive wire, and two core members containing metal magnetic grains is suitably used as a small and high-performance coil component which does not use a bobbin or the like.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2015-195267, filed Sep. 30, 2015, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil component comprising:

a preformed coil that is formed of a winding part which winds a coated conductive wire continuously and spirally in an axial direction and includes an inner circumferential surface, an outer circumferential surface, and a principle face of one end portion and a principle face of the other end portion in the axial direction, and of a pair of leader parts which extends outwardly from the winding part;

a first core member that includes a shaft part disposed inside the inner circumferential surface, a side wall portion disposed in at least a portion of the outer circumferential surface, and a connection portion which is disposed such that a first gap is formed between the principle face of the one end portion and the connection portion, and through which the shaft part is connected to the side wall portion, and that contains metal magnetic grains; and a second core member which is disposed such that a second gap is formed between the principle face of the other end portion and the second core member which contains metal magnetic grains and is provided with an adhesive, wherein:

the pair of leader parts are disposed in a portion where the side wall portion of the first core member is not formed on the outer circumferential surface of the winding part, and the pair of leader parts are not covered by the side wall portion, the coil component further comprises a pair of terminal electrodes formed at respective ends of the leader parts in a manner extending in a same direction and facing the principle face of the other end portion of the winding part, wherein a peripheral portion of the second core member including a portion of the second gap provided with the adhesive is in direct contact with and fitted between the principle face of the other end portion of the winding part and the pair of terminal electrodes, the second core member is of an E-type wherein the second core member includes a second shaft part facing and axially aligned with the shaft part of the first core member, a second side wall portion facing and axially aligned with the side wall portion of the first core member, and a second connection portion connecting the second shaft part and the second side wall portion, and the first gap formed between the principle face of the one end portion of the winding part and the connection portion of the first core member is constituted by a void.

2. A coil component according to claim 1, wherein:

a third gap is provided between the shaft part and the second core member, and a fourth gap is provided between the side wall portion and the second core member, which is larger in distance than the third gap.

3. A coil component according to claim 1, wherein:

a fifth gap is provided between the leader parts and a side surface of the second core member.

4. A coil component according to claim 2, wherein:

a fifth gap is provided between the leader parts and a side surface of the second core member.

5. A coil component according to claim 1, wherein the second core member has a tapered surface toward a bottom surface where the peripheral portion of the second core member including the portion of the second gap provided with the adhesive is in contact with and fitted between the principle face of the other end portion of the winding part and the pair of terminal electrodes.

6. A coil component according to claim 1, wherein the principle face of the other end portion of the winding part is fitted in a groove of the second core member via the adhesive, wherein the groove is formed between the second shaft part and the second side wall portion.

7. A coil component according to claim 1, wherein the outer circumferential surface of the winding part protrudes from the first and second core members between the pair of leader parts on a side of the first and second core members where the pair of leader parts are disposed and no side wall portion of the first core member is formed, as viewed in the axial direction.

8. A coil component according to claim 1, wherein a height of the shaft part of the first core member is larger than that of the second core member.

* * * * *